US005897255A

United States Patent [19]

Ackley

[11] Patent Number: 5,897,255

[45] Date of Patent: Apr. 27, 1999

[54] SPEED FONTS FOR MATRIX PRINTERS

[75] Inventor: H. Sprague Ackley, Seattle, Wash.

[73] Assignee: Intermec IP Corp., Beverly Hills, Calif.

[21] Appl. No.: 08/518,424

[22] Filed: Aug. 23, 1995

[51] Int. Cl.[6] ..... B41J 2/36

[52] U.S. Cl. ..... 400/120.09; 400/120.11

[58] Field of Search ..... 400/120.02, 120.04, 400/103, 104, 74, 120.09, 120.1, 120.11; 347/19

[56] References Cited

U.S. PATENT DOCUMENTS

| | | | |
|---|---|---|---|
| 3,975,707 | 8/1976 | Ito et al. | 347/76 R |
| 4,397,709 | 8/1983 | Schwenzer | 156/351 |
| 4,567,488 | 1/1986 | Moriguchi et al. | 346/76 PH |
| 4,639,287 | 1/1987 | Sakura | 156/361 |
| 4,795,281 | 1/1989 | Ulinski, Sr. et al. | 400/74 |
| 4,824,266 | 4/1989 | Fujii et al. | 400/120 |
| 4,864,112 | 9/1989 | Imai et al. | 235/463 |
| 4,870,428 | 9/1989 | Kuwabara et al. | 346/76 PH |
| 4,937,590 | 6/1990 | Robillard et al. | 346/76 PH |
| 5,007,748 | 4/1991 | Lee et al. | 400/103 |
| 5,023,437 | 6/1991 | Speicher | 235/432 |
| 5,056,429 | 10/1991 | Hirosaki | 100/93.01 |
| 5,183,343 | 2/1993 | Tazawa et al. | 400/103 |
| 5,229,587 | 7/1993 | Kimura et al. | 400/103 |
| 5,480,239 | 1/1996 | Kim et al. | 400/76 |
| 5,488,223 | 1/1996 | Austin et al. | 347/19 |
| 5,564,841 | 10/1996 | Austin et al. | 347/19 |
| 5,688,056 | 11/1997 | Peyret | 400/103 |
| 5,711,621 | 1/1998 | Austin | 400/74 |

FOREIGN PATENT DOCUMENTS

| | | | |
|---|---|---|---|
| 0 092 748 | 11/1983 | European Pat. Off. . | |
| 0 329 369 A2 | 8/1989 | European Pat. Off. | 400/103 |
| 60-73852 | 4/1985 | Japan . | |
| 61-22960 | 1/1986 | Japan . | |
| 2 228 450 | 8/1980 | United Kingdom | 400/103 |
| WO 94/15842 | 7/1994 | WIPO . | |

OTHER PUBLICATIONS

Bassetti, L. W. and S. Kantor, "Print Enhancement for Laser Printers," *IBM Technical Disclosure Bulletin* 27:5, Oct., 1984, pp. 3071–3072.

"Table of Contents," *IBM Technical Disclosure Bulletin* 27:5, Oct., 1984, pp. 1–xvi.

H. Sprague Ackley, Dot Printers with Width Compression Capabilities, May 27, 1997, pp. 1–15, USSN 08/518,226.

IBM Technical Disclosure Bulletin vol. 27 No. 4B Sep. 1984.

*Primary Examiner*—John Hilten
*Attorney, Agent, or Firm*—Seed and Berry LLP

[57] ABSTRACT

A method of printing font character bars comprised of a plurality of rows in a direction of printing movement perpendicular to the font character bars which are in turn comprised of a plurality of close adjacent dots to improve print quality at printing speeds which induce elongated dot smear in the direction of printing movement. The method comprises removing one dot or more from an end of each of the plurality of rows of a font character bar which is otherwise over-widened from dot smear. Partial dot removal can also be employed.

21 Claims, 5 Drawing Sheets

SPEED FONTS FOR MATRIX PRINTERS

BACKGROUND OF THE INVENTION

1. Technical Field

This invention relates to printing with moving media dot matrix printers and, more particularly, to a method of printing font character bars comprised of a plurality of rows in a direction of printing movement perpendicular to the font character bars which are in turn comprised of a plurality of close adjacent dots to improve print quality at printing speeds which induce elongated dot smear in the direction of printing movement comprising the step of removing one dot or more from an end of each of the plurality of rows of a font character bar which is otherwise over-widened from dot smear.

2. Background Art

Moving dot matrix printing devices have long been employed as output devices for computers. The term "moving dot matrix printing device" is employed to differentiate printers such as thermal transfer and impact dot matrix from laser printers which employ a technique more akin to xerography. What is being addressed is relative movement between the media and the printhead. Either (or both) can be moving with regard to the present invention and the problem addressed and solved thereby.

A typical high-speed impact dot matrix printer is shown in simplified form in FIG. 1 where it is generally indicated as 10. The printer 10 employs a printhead 12 which is driven bi-directionally across the media 14 by a motor 16 through a tape drive 18. In slower speed printers, the motor 16 can be a stepping motor which can be used by the controlling logic 20 to both drive and accurately position the printhead 12 horizontally on the media 14. With high-speed printers as wherein the present invention is particularly useful, a position sensor 22 provides the horizontal step position of the printhead 12 to the logic 20 so that the logic 20 knows when to fire the printhead 12 to create the dots on the media 14 forming the characters being printed. The printheads 12 come in a variety of printing patterns with the print pin(s) thereof comprising everything from a single dot to multiple dots as well as straight lines, slanted lines, and cluster patterns. The present invention is most applicable to printheads having one or more print pins oriented in a straight vertical line with respect to the horizontal movement of the printhead 12.

A thermal printing printer 24 as wherein the present invention is applicable is typically configured as in FIGS. 2 and 3. In this case, the printhead 12' is stationary across the path of movement of the media 14 and the media 14 is moved under the printhead in steps by a platen roller 26 driven by a stepping motor 26 under the control of logic 20', which also controls the printing by the printhead 12'. A thermal printhead 12' is comprised of a plurality of adjacent thermal printing elements (not shown) which heat when an electrical signal is applied to them. By placing a ribbon (not shown) containing a heat-transferable ink between the printhead 12' and the media 14, dots or pixels of the ink can be selectively transferred to the surface of the media 14 to create the characters and/or graphics being output. Ideally, each thermal printing element would reach its printing temperature instantly and instantly return to its ambient temperature printing a perfect dot 28 as in FIG. 4. Unfortunately, while performance is good, it is not ideal. Rather, there is a ramp-up time, a printing time, and a ramp-down time of the temperature of the printing elements. Thus, if there is movement of the media 14 under the printhead 12', instead of the ideal dot 28 of FIG. 4, what is printed is the smeared or extended dot 28' of FIG. 5.

A similar situation can occur in the impact dot matrix printer 10. The printhead 12 moves back and forth over the media 14 while the media 14 moves up line by line under the path of the printhead 12 at the end of each printing pass of the printhead 12. Early slow impact dot matrix printers disposed an inked ribbon between the printhead and the media and were not concerned with the speed of ribbon movement relative to the printhead speed. As printhead speeds were increased to increase the printer throughput, it was found that smear would occur if there was a difference between the ribbon speed and the printhead speed. Thus, the ribbon speeds were linked to the printhead speeds. Bi-directional printing, ultra-high printhead speeds, differences in ribbon quality, and relative changes at the ends of ribbons in rebound printers, for example however, created a situation in which smear can take place once again and, therefore, is a factor which must be taken into consideration. Thus, instead of getting a clear dot 28 in the shape of the end of the printing pin as depicted in FIG. 6, an elongated dot 28' as in FIG. 7 is produced. Ribbon type, age, ink content, and printer speed all affect the degree of elongation. In both the printers 10 and 24, however, speed is the most influential factor relative to dot elongation in the direction of relative printhead movement.

A typical dot matrix font character definition is shown in FIG. 8. To print the capital "P" using dots by any printing method, the printer will print the series of dots 28 shown. Where smearing as in FIG. 5 or 7 occurs, the strokes of the character will be extended in the direction of movement as depicted in FIG. 9. Such printing is, of course, generally unacceptable.

Wherefore, it is the object of the present invention to provide a way of compensating the characters printed by a moving dot matrix printer for smear along the direction of movement caused by any source.

Other objects and benefits of this invention will become apparent from the description which follows hereinafter when read in conjunction with the drawing figures which accompany it.

SUMMARY

The foregoing objects have been achieved by the method of the present invention for printing font character bars comprised of a plurality of rows in a direction of printing movement perpendicular to the font character bars which are in turn comprised of a plurality of close adjacent dots to improve print quality at printing speeds which induce elongated dot smear in the direction of printing movement comprising the step of, removing one dot or more from an end of each of the plurality of rows of a font character bar which is otherwise over widened from dot smear.

In one embodiment, the method comprises removing dot width from an end of each of the plurality of rows of a character bar which is otherwise over-widened from dot smear in an amount substantially equal to the dot smear.

In another embodiment, the method comprises removing one dot from an end of each of the plurality of rows of a font character bar which is otherwise over-widened from dot smear. Or, removing two or more dots from an end of each of the plurality of rows of a font character bar which is otherwise overwidened from dot smear.

In a preferred approach, the method comprises, maintaining a table of character font descriptors for normal fonts and fonts with one less dot per row; using the normal fonts when the character bars are not being smeared; and, using the fonts with one less dot per row when the character bars are being smeared. A version wherein the table includes character definitions incorporating the removal of two dots and more than two dots is also contemplated.

DESCRIPTION OF THE PREFERRED EMBODIMENT

Figure 1:
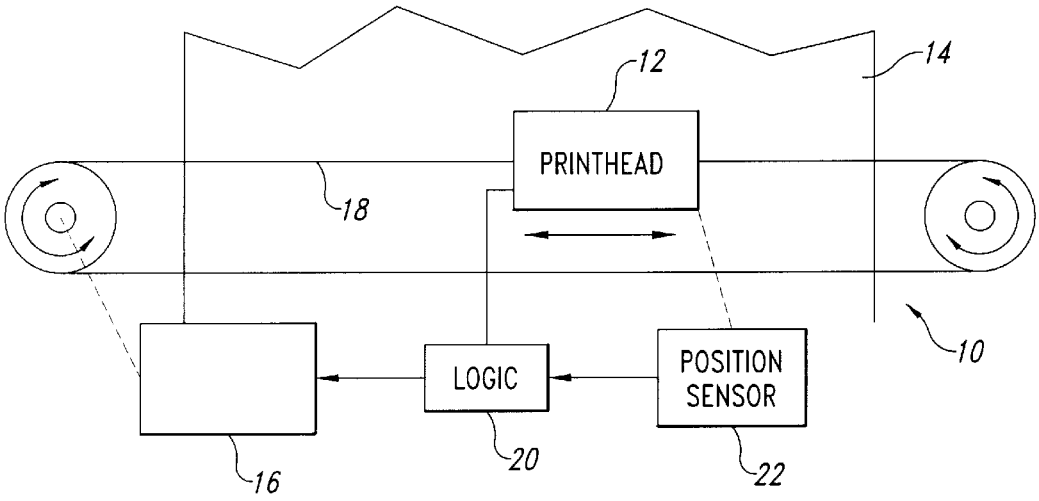
FIG. 1 is a simplified plan view drawing of a high-speed impact dot printer.
Figure 2:
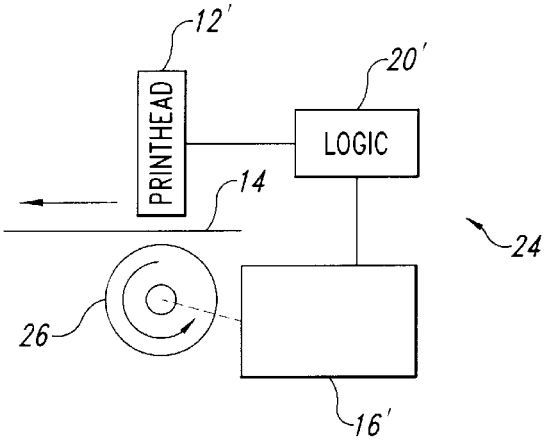
FIG. 2 is a simplified side view drawing of a thermal dot printer.
Figure 3:
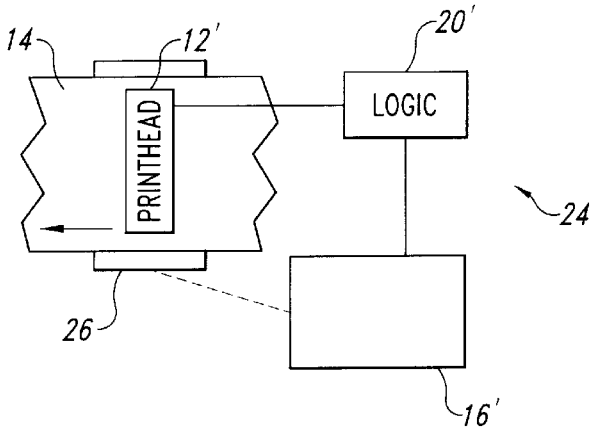
FIG. 3 is a simplified plan view drawing of the thermal dot printer of FIG. 2.
Figure 4:
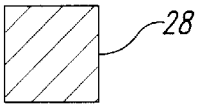
FIG. 4 is a simplified drawing of one pixel or dot as produced by a thermal printing element under ideal conditions.
Figure 5:
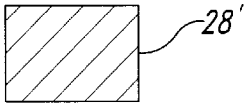
FIG. 5 is a simplified drawing of one smeared pixel or dot as produced by a thermal printing element under non-ideal moving conditions.
Figure 6:
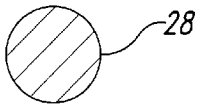
FIG. 6 is a simplified drawing of one pixel or dot as produced by an impact printing wire under ideal conditions.
Figure 7:
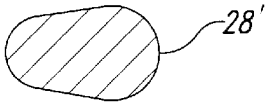
FIG. 7 is a simplified drawing of one smeared pixel or dot as produced by an impact printing wire under non-ideal moving conditions.
Figure 8:
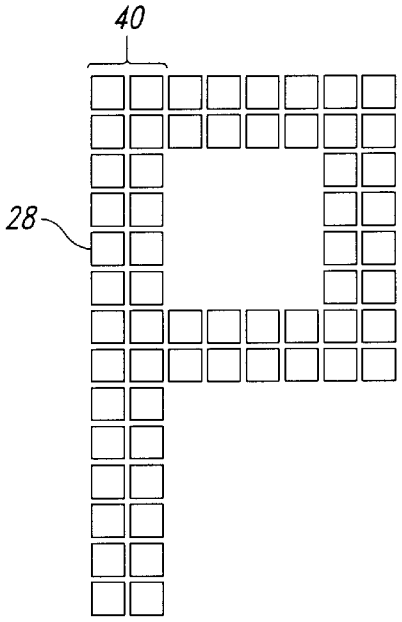
Fig. 8 (PRIOR ART)
FIG. 8 is an enlarged drawing of an alphanumeric font character definition as employed in a typical prior art dot matrix printer.
Figure 9:
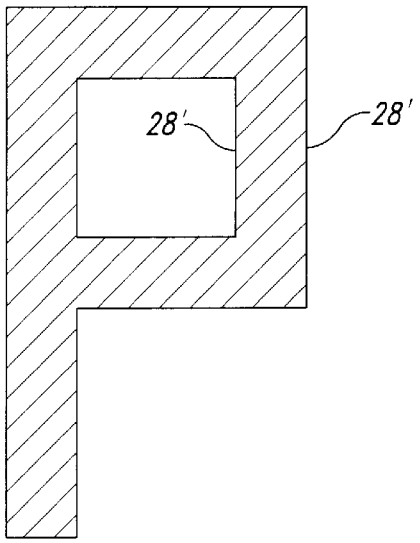
Fig. 9 (PRIOR ART)
FIG. 9 is an enlarged drawing of the alphanumeric font character of FIG. 8 as printed by a typical prior art dot matrix printer when smearing occurs.
Figure 10:
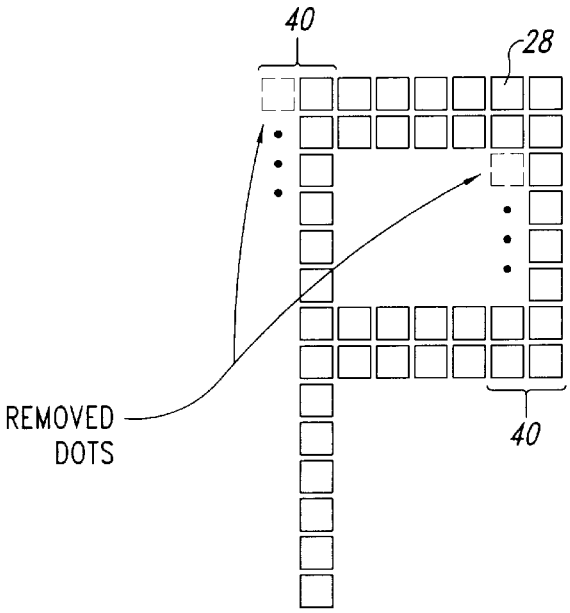
FIG. 10 is an enlarged drawing of the alphanumeric font character definition of FIG. 8 modified according to the present invention for high-speed printing in a first embodiment wherein an entire dot is removed along vertical lines.
Figure 11:
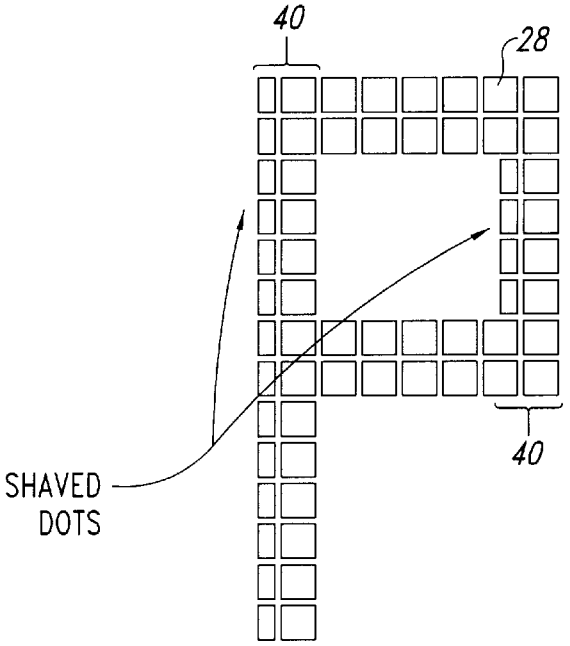
FIG. 11 is an enlarged drawing of the alphanumeric font character definition of FIG. 8 modified according to the present invention for high-speed printing in a second embodiment wherein a partial dot is removed along vertical lines.

In its most basic implementation, the objects of the present invention are achieved by reducing the number of dots in the direction of movement in an amount which is offset by the smear of the remaining dots. This is illustrated in the character re-definitions of FIGS. 10 and 11. Assuming horizontal movement creating horizontal smearing, the vertical elements 40 are reduced in their number of dots 28 (FIG. 10) or total dot width (FIG. 11). That is, the vertical elements 40 are made thinner by either of the two methods previously described. When printed with smeared dots 28' as in FIGS. 5 and 7, the resultant printed character will then appear as defined in FIG. 8 since the wider dots 28' will offset the narrower definition and actually create vertical elements 40 of the desired width. This would be true and the same approach would be used regardless of the type of font employed, with or without serifs.

With regard to the manner and apparatus for effecting the shaving of the vertical elements, reference is made to a co-pending application by the inventor herein entitled DOT PRINTERS WITH WIDTH COMPRESSION CAPABILITIES filed on even date herewith as serial number 08/518,226, and assigned to the common assignee of this invention, the teachings of which are incorporated herein by reference. As will be seen from a reference thereto, the objects of the present invention can be attained by removing one or more entire columns of dots 28 as in the font definition of FIG. 10 or by designating the column of dots 28 to be "shaved" which is accomplished at print time by moving the dot printing position by half (or other fraction) of its normal distance thereby causing adjacent dots 28 to be overlapped which yields a reduced two-adjacent-dots width.

Figure 12:
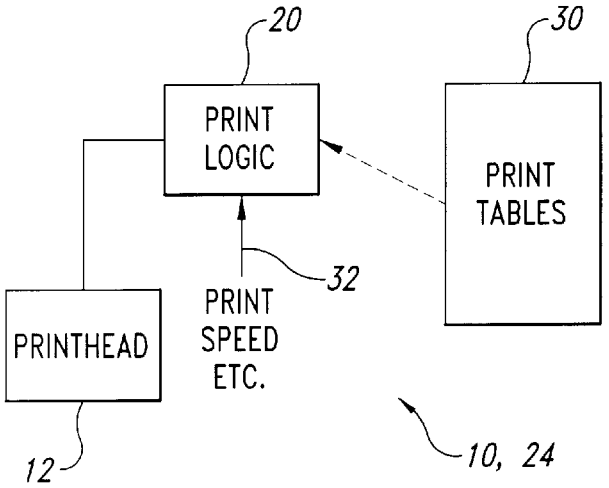
FIG. 12 is a simplified drawing of a dot matrix printing system according to the present invention in a preferred embodiment.

While the foregoing basic technique could be incorporated directly into a unidirectional thermal printer of known and constant speed, further consideration must be made for other printing situations wherein the font definition would have to change under dynamic conditions. For example, in a bidirectional rebound impact printer the character definition may well have to change as a function of its position on the printed page and as a result of ribbon wear. FIG. 12 is a very simplified drawing of a generic dot matrix printer 10,24 in a preferred implementation according to the present invention. There is a printhead 12 which is driven by print logic 20. The print logic 20 dynamically obtains its font character definitions from a print table 30 which will be described in greater detail shortly. Which character definition to choose and employ is determined by the inputs on line 32 which are a function of the parameters of the printer affecting the dot quality (i.e. amount of smearing) at each instant of printing. Such factors could be printing speed, ribbon quality, ribbon type, and printhead position.

Figure 13:
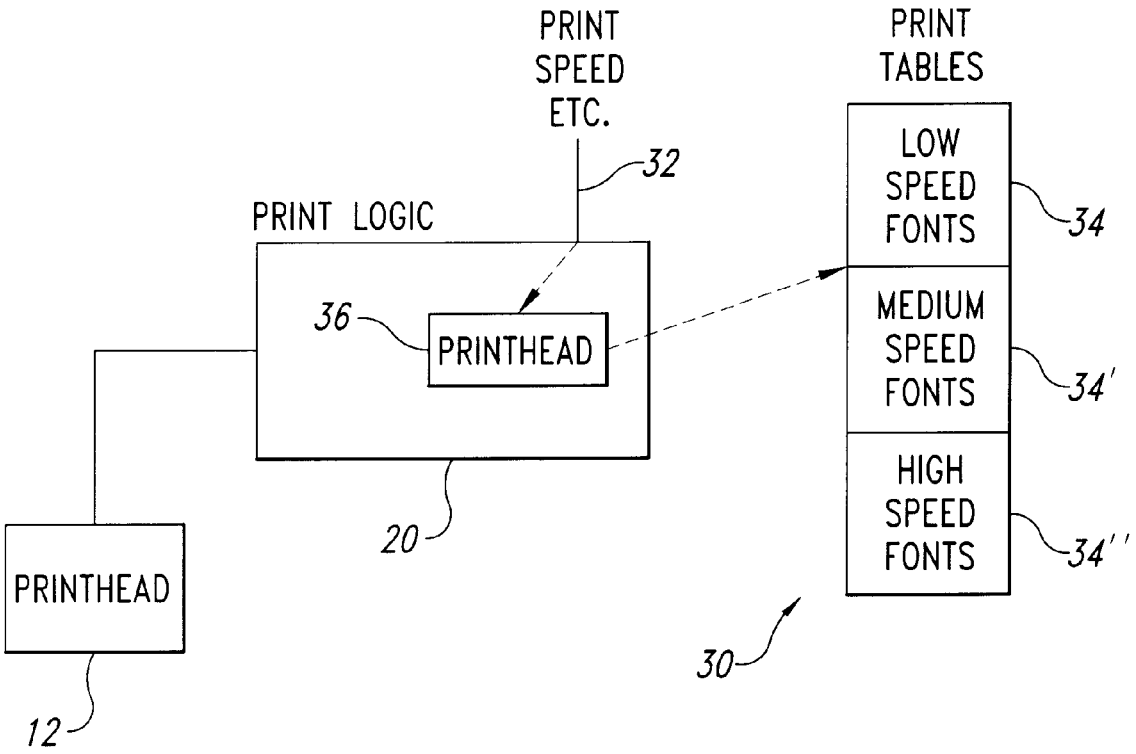
FIG. 13 is a drawing showing the preferred manner of selecting font definitions for printing in the present invention.

While font physiology could be calculated in real-time from a basic font definition, the slower computers typically employed in low-cost printers would make such an approach impractical in most cases. Thus, the table look-up approach depicted in FIG. 13 is the preferred implementation of the present invention. The fonts are pre-defined in the computer memory print table 30. Quite often, only one row of dots (or even a partial, i.e. "shaved", row) difference may be sufficient to solve any problem. In such case, the table 30 would contain one set of font definitions 34 for "normal" fonts and one set of font definitions 34' for high-speed fonts. For other situations, additional font definitions 34" as necessary could be provided. In the example shown, the font definitions 34, 34', and 34" might comprise no modification for low speed operation, one dot removal for medium speed operation, and removal of two dots for high speed operation. The fonts being used to print are accessed through an pointer 36 associated with the logic 20 which is changed as a function of the determining criteria on line 32. In that manner, the accessing of different fonts under different criteria provides no computational time penalty.

Wherefore, having thus described the present invention, what is claimed is:

1. A method of printing font character bars comprised of a plurality of rows in a direction of printing movement perpendicular to the font character bars which are in turn comprised of a plurality of closely adjacent dots to print substantially with desired dimensions at printing speeds which induce elongated dot smear in the direction of printing movement comprising the steps of:

identifying a font character bar having expected elongation from dot smear;

removing at least a portion of a dot from a same first end of each of the plurality of rows in the identified font character bar; and printing a dot at a same second end of each of the plurality of rows in the identified font character bar.

2. The method of claim 1 wherein said step of removing at least a portion of a dot from a same first end of each of the plurality of rows in the identified font character bar comprises:

determining an amount of dot smear; and removing dot width from a same first end of each of the plurality of rows of the identified character bar in an amount substantially equal to the determined dot smear.

3. The method of claim 1 wherein said step of removing at least a portion of a dot from a same first end of each of the plurality of rows in the identified font character bar comprises:

removing an entire dot from a same first end of each of the plurality of rows of the identified font character bar.

4. The method of claim 1 wherein said step of removing at least a portion of a dot from a same first end of each of the plurality of rows in the identified font character bar comprises:

removing a plurality of dots from a same first end of each of the plurality of rows of the identified font character bar.

5. The method of claim 1 wherein said step of removing at least a portion of a dot from a same first end of each of the plurality of rows of the identified font character bar comprises:

a) maintaining a table of character font descriptors for normal fonts and fonts with one less dot per row;

b) using the normal fonts when the character bars are not being smeared; and c) using the fonts with one less dot per row when printing the identified font character bar.

6. A method of printing font character bars comprised of a plurality of rows in a direction of printing movement perpendicular to the font character bars which are in turn comprised of a plurality of close adjacent dots to improve print quality at printing speeds which are predicted to induce elongated dot smear in the direction of printing movement comprising the steps of:

selecting a set of font character bars having predicted dot smear; and removing at least a dot portion from only one of a first end and a second end of each of the plurality of rows of the selected font character bars for which dot smear is predicted.

7. The method of claim 6 wherein said step of removing at least a dot portion from only one of a first end and a second end of each of the plurality of rows of the selected font character bars for which dot smear is predicted comprises:

determining an expected dot smear; and removing the dot portion from an end of each of the plurality of rows of a character bar equal to the expected dot smear.

8. The method of claim 6 wherein said step of removing at least a dot portion from only one of a first end and a second end of each of the plurality of rows of the selected font character bars for which dot smear is predicted comprises:

removing an entire dot from an end of each of the plurality of rows of the selected font character bars.

9. The method of claim 6 wherein said step of removing at least a dot portion from only one of a first end and a second end of each of the plurality of rows of the selected font character bars for which dot smear is predicted comprises:

removing a plurality of dots from an end of each of the plurality of rows of the selected font character bars.

10. The method of claim 6 wherein said step of removing at least a dot portion from only one of a first end and a second end of each of the plurality of rows of the selected font character comprises:

a) maintaining a table of character font descriptors for normal fonts and for fonts with one less dot per row than the normal fonts;

b) using character font descriptors for the normal fonts when the character bars are not being smeared; and, c) using character font descriptors for the fonts with one less dot per row when the character bars are being smeared.

11. The method of claim 6 wherein the font character bars define human readable symbols.

12. The method of claim 6 wherein the font character bars define portions of machine readable symbols.

13. The method of claim 12 wherein the machine readable symbols are bar code symbols.

14. A method of printing font character bars comprised of a plurality of rows in a direction of printing movement perpendicular to the font character bars which are in turn comprised of a plurality of close adjacent dots to improve print quality at printing speeds which are expected to induce elongated dot smear in the direction of printing movement comprising the steps of:

a) maintaining a table of character font descriptors for normal fonts, fonts having bars with one less dot per row, and fonts having bars with two less dots per row;

b) using the character font descriptors for normal fonts when the character bars are not being smeared;

c) using the character font descriptors for fonts with only one less dot per row when the character bars are being smeared in a first range; and, d) using the character font descriptors for fonts with two less dots per row when the character bars are being smeared in a second range greater than the first range.

15. The method of claim 14 further including the steps of:

identifying from the character font descriptors in the table, a character font descriptor corresponding most closely to the dot smear; and selecting for use the identified character font descriptor.

16. The method of claim 15 wherein the font character bars define human readable symbols.

17. The method of claim 15 wherein the font character bars define portions of machine readable symbols.

18. The method of claim 17 wherein the machine readable symbols are bar code symbols.

19. The method of claim 11 wherein the font character bars define human readable symbols.

20. The method of claim 19 wherein the font character bars define portions of machine readable symbols.

21. The method of claim 20 wherein the machine readable symbols are bar code symbols.

* * * * *